US006725950B2

(12) United States Patent
Palm

(10) Patent No.: US 6,725,950 B2
(45) Date of Patent: Apr. 27, 2004

(54) POST HOLE DIGGER

(75) Inventor: Andrew William Palm, Alton Downs (AU)

(73) Assignees: Andrew W. Palm, Alton Downs (AU); Megan Jane Morris, Rockhampton (AU)

( * ) Notice: Subject to any disclaimer, the term of this patent is extended or adjusted under 35 U.S.C. 154(b) by 0 days.

(21) Appl. No.: 10/068,125

(22) Filed: Feb. 5, 2002

(65) Prior Publication Data

US 2003/0146021 A1 Aug. 7, 2003

(51) Int. Cl.[7] ..... E21B 7/02

(52) U.S. Cl. ..... 175/162; 175/203; 175/170; 173/145

(58) Field of Search ..... 175/203, 170, 175/162; 173/145

(56) References Cited

U.S. PATENT DOCUMENTS 2,810,550 A * 10/1957 Cohen et al. ..... 175/162
2,844,006 A * 7/1958 Lutz et al. ..... 173/124
2,890,860 A * 6/1959 Smith ..... 173/140
D213,792 S * 4/1969 Smith ..... D15/28
3,555,868 A * 1/1971 Hagemeyer ..... 72/154
3,700,045 A 10/1972 Coontz
4,193,459 A * 3/1980 Engstrom ..... 173/193
4,601,348 A * 7/1986 Cox ..... 173/25
5,507,354 A 4/1996 Harleman
5,592,993 A * 1/1997 Parish et al. ..... 175/162
5,658,091 A * 8/1997 Goughnour et al. ..... 405/50

* cited by examiner

*Primary Examiner*—David Bagnell
*Assistant Examiner*—Giovanna Collins
(74) *Attorney, Agent, or Firm*—DeLio & Peterson, LLC

(57) ABSTRACT

A post hole digger has a frame attached to three-point linkage of a tractor. A boom has its proximal end pivotally connected to the frame, and an auger is pivotally mounted to the distal end of the boom. The boom is formed by a pair of laterally spaced arms, each of which is an integrally formed angled arm. The boom arms are bent from straight lengths of steel in a cold working process, to reduce manufacturing time and cost.

12 Claims, 4 Drawing Sheets

POST HOLE DIGGER

This invention relates to an improved post hole digger. In particular, the invention is directed to a tractor-mounted, hydraulic thrust, post hole digger having an improved boom construction.

BACKGROUND ART

There are various types of known tractor-mounted post hole diggers, and examples can be found in U.S. Pat. Nos. 3,700,045 and 5,507,354. Such post hole diggers typically have an auger rotatably mounted on a frame which is attached to the three-point hitch at the rear of a tractor. The auger may be driven by the tractor's power take off (PTO).

The post hole digger of U.S. Pat. No. 5,507,354 is an example of a power-assisted drilling apparatus, sometimes known as a "hydraulic thrust" post hole digger, in which a downward force is applied to an auger as the auger is rotated, in order to provide faster and more efficient penetration of the earth, particularly in hard or rock-laden soils.

The post hole digger of U.S. Pat. No. 5,507,354 has a boom assembly comprising a pair of laterally displaced bipartite booms. Each boom comprises first and second arms welded together with an angle of approximately 45° therebetween. The second arm of each boom (i.e. the arm more distant from the tractor) is shorter than the first arm.

Boom assemblies (hereinafter referred to simply as "booms") which are used in post hole diggers, such as that of U.S. Pat. No. 5,507,354, are typically formed from lengths of steel tubular sections which are cut, positioned and welded to form a desired configuration. The cutting and welding of such sections is a time consuming process which adds to the cost of manufacture, and hence the cost of the finished product.

Moreover, considerable forces may be applied to the booms in use, e.g. when hydraulic thrust drilling in hard or rock-laden soils. Such forces create high stresses at the rigid angled joints of the boom arms, with potential failure of the joints if not constructed properly. Increasing the size of the boom arms to accommodate such stresses increases the overall weight of the post hole digger.

It is an object of this invention to provide an improved boom for a post hole digger which overcomes or at least ameliorates, the abovedescribed disadvantages.

SUMMARY OF THE INVENTION

In one form, the invention provides drilling apparatus comprising

- a frame suitable for attachment to a three-point hitch at the rear of a tractor,
- a boom pivotally connected at its proximal end to the frame, the boom being pivotable relative to the frame about a substantially horizontal pivot axis,
- an auger rotatably mounted to the boom at or near the distal end of the boom,
- a hydraulic cylinder connected between the boom and the frame, for pivoting the boom relative to the frame to thereby raise or lower the auger,
- wherein the boom comprises a pair of boom arms spaced laterally apart and connected by at least one crosspiece located intermediate the ends of each boom arm, each boom arm being an integrally formed angled arm which extends substantially from the proximal end to the distal end of the boom,

- and wherein the hydraulic cylinder is connected between the frame and the crosspiece, and is located wholly above the pivot axis.

The term "angled arm" as used in this specification is intended to include a curved arm, as well as an arm having a curved portion along its length.

Typically, the drilling apparatus is a tractor-mounted post hole digger.

Each angled arm may comprise a first (proximal) straight portion, a second (distal) straight portion and a curved portion between the two straight portions. The distal straight portion is preferably longer than the proximal straight portion.

Each angled arm is typically formed from a length of metal tube shaped by a cold working process, such as bending in a pipe bender.

By forming the boom from unipartite angled arms, the manufacturing costs are substantially reduced. Moreover, the use of unipartite angled arms with curved portions provides mechanical strength and flexing advantages over similarly sized welded constructions, thereby enabling the size of the arms to be reduced for a given strength rating.

In another form, the invention provides a boom for a tractor-mounted post hole digger, the boom comprising a pair of boom arms spaced laterally apart and connected by at least one crosspiece located intermediate the ends of each boom arm, each boom arm being an integrally formed unipartite angled arm extending substantially the whole length of the boom, and wherein each angled arm comprises a proximal straight portion, a distal straight portion, and a curved portion between the proximal and distal portions.

In order that the invention may be more fully understood and put into practice, a preferred embodiment will now be described by way of example, with reference to the accompanying drawings.

DESCRIPTION OF PREFERRED EMBODIMENT

Figure 1:
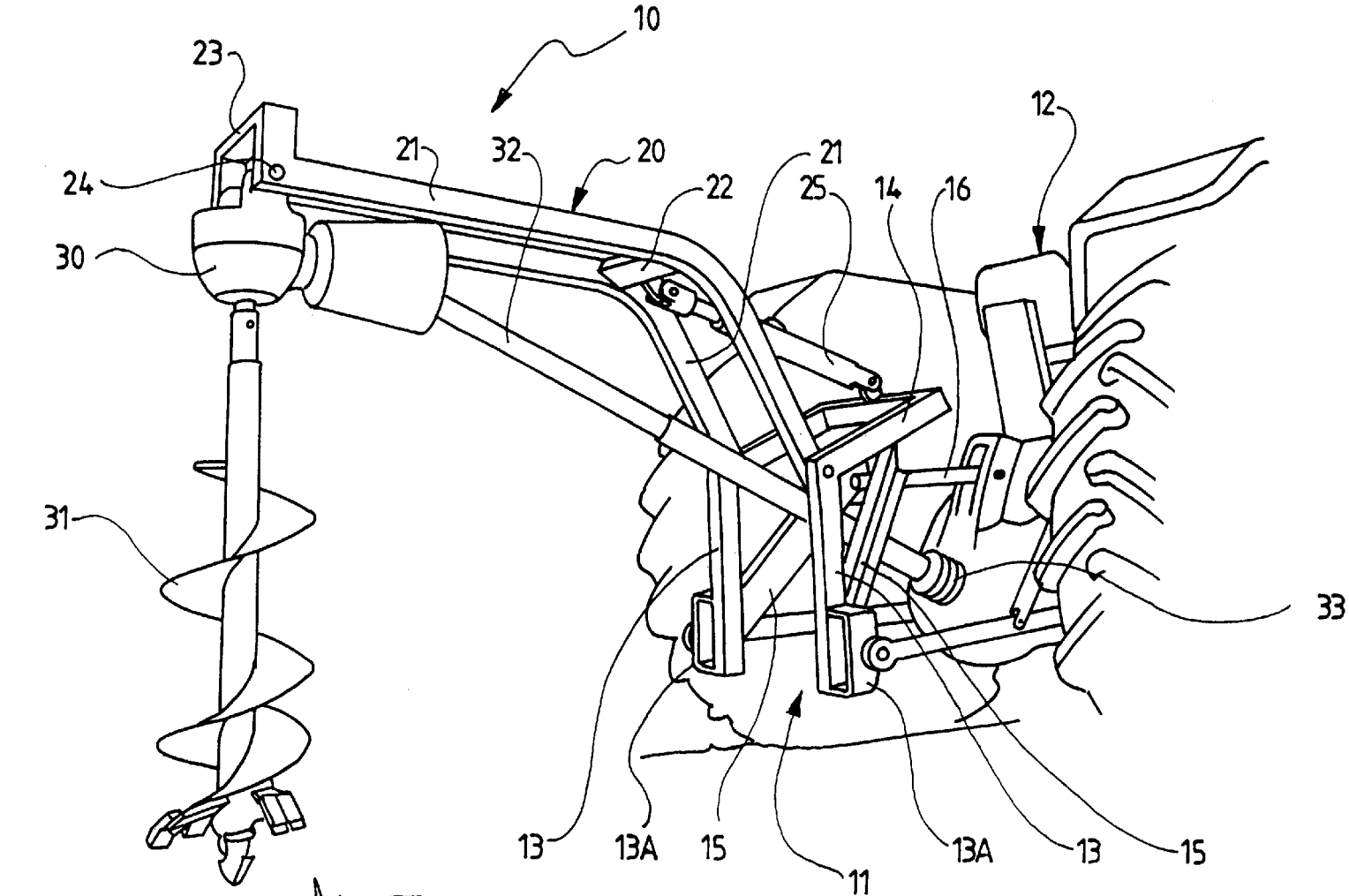
FIG. 1 is a perspective view of a post hole digger according to one embodiment of the invention, attached to a tractor.
Figure 2:
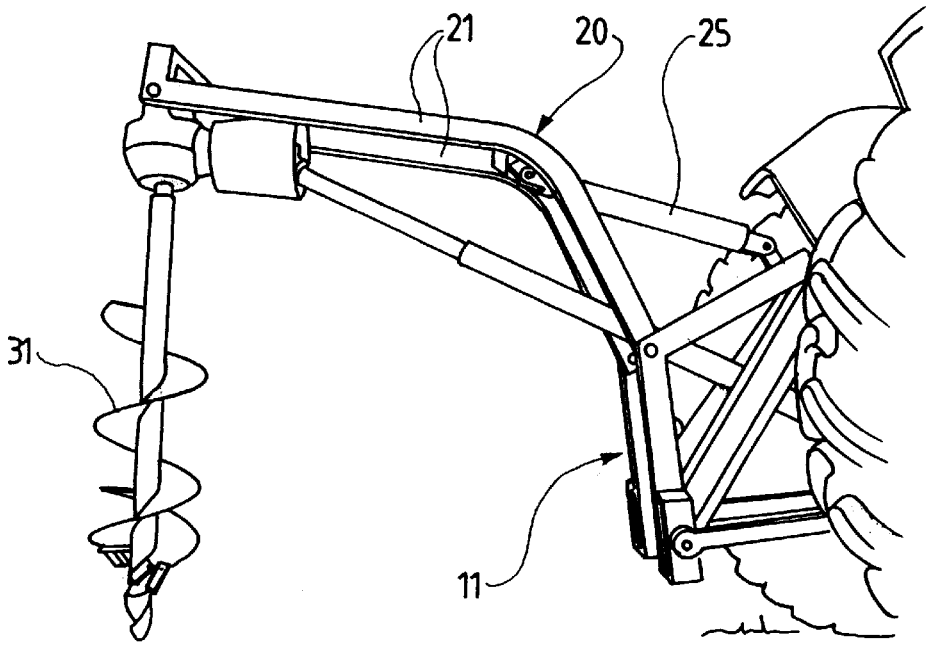
FIG. 2 is a side view of the post hole digger of FIG. 1 in an elevated position.
Figure 3:
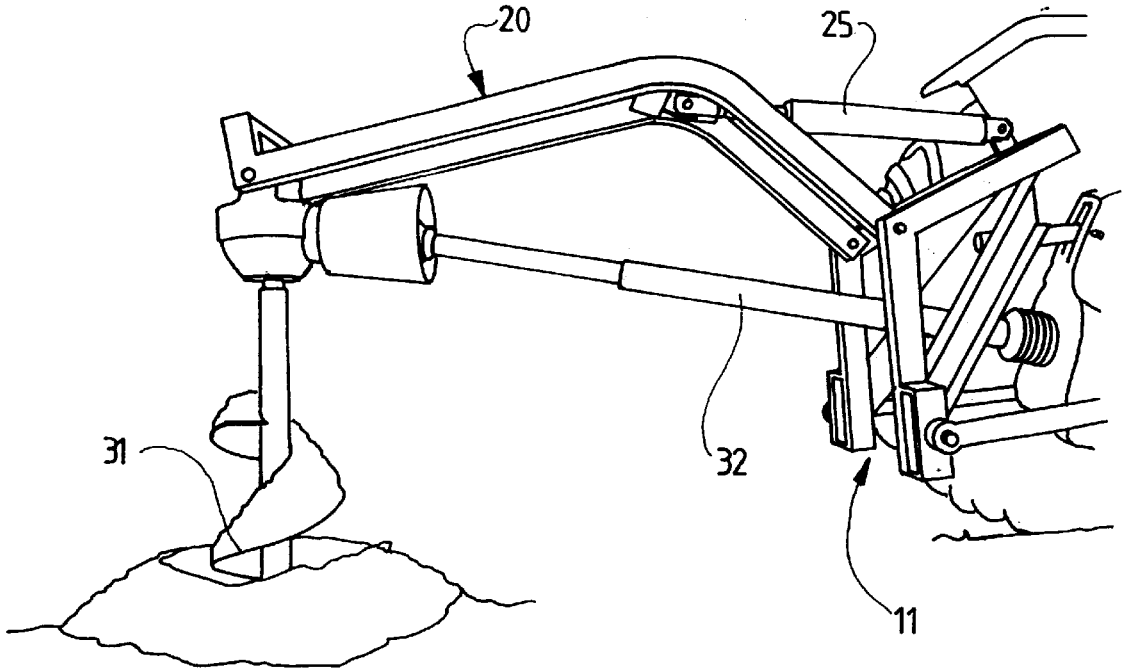
FIG. 3 is a side view of the post hole digger of FIG. 1 in a lowered (digging) position.
Figure 4:
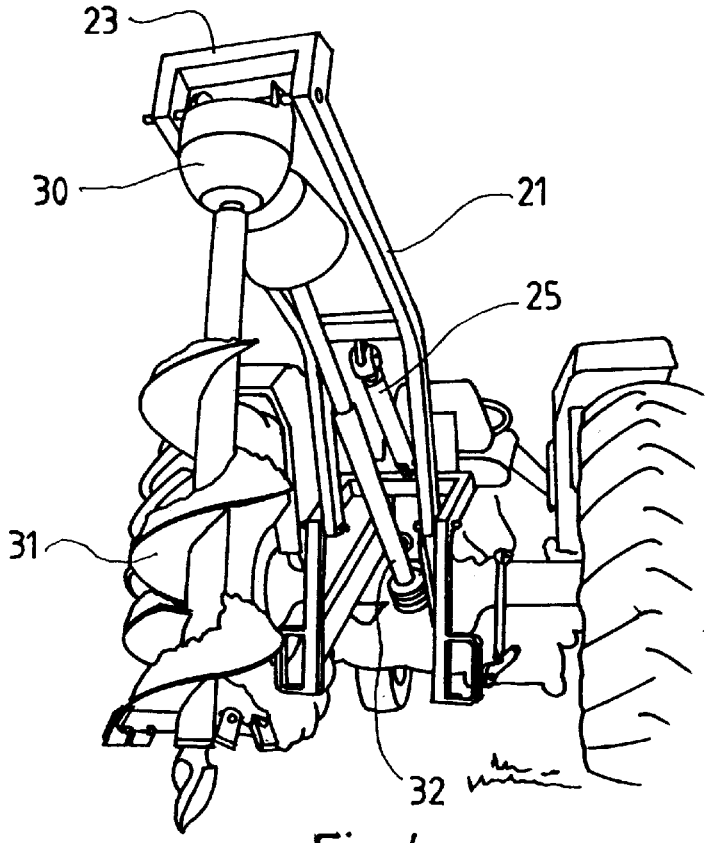
FIG. 4 is a rear perspective view of the post hole digger of FIG. 1 in an elevated position.
Figure 5:
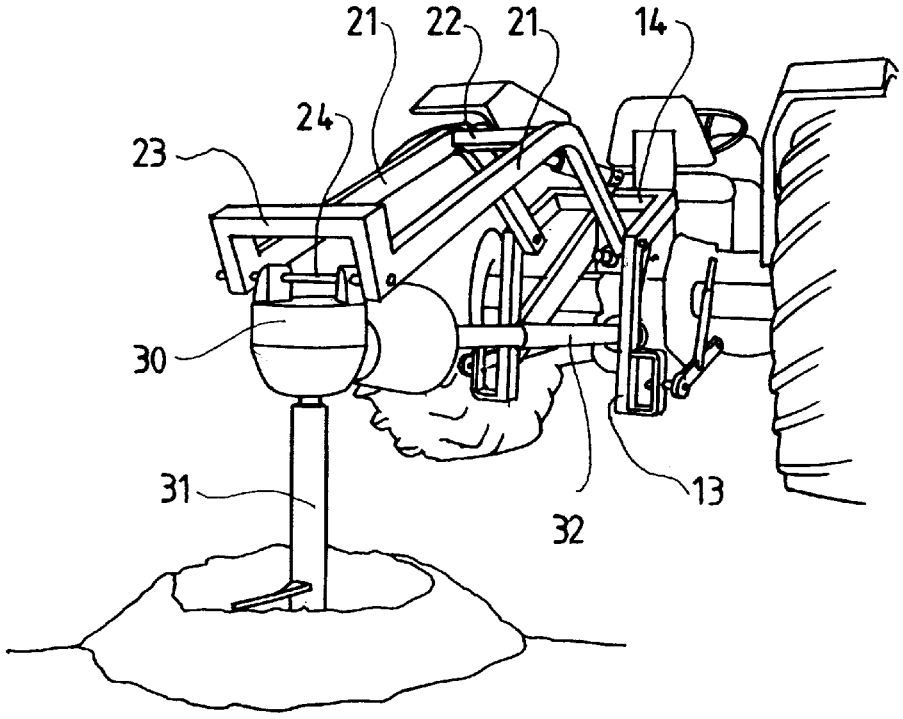
FIG. 5 is rear perspective view of the post hole digger of FIG. 1 in a lowered (digging) position.

FIGS. 1 to 5 illustrate drilling apparatus in the form of a post hole digger 10, according to one embodiment of the invention. The post hole digger 10 comprises a frame 11 which, in use, is attached to the three-point hitch or linkage commonly found at the rear of a tractor 12. The frame 11 comprises a pair of spaced legs 13 joined by a yoke 14. Struts 15 extend between the legs 13 and the yoke 14 to strengthen and provide rigidity to the frame 11. Brackets 13A are attached to the bottom of the legs 13 to provide pivotal mountings between the legs 13 and the two lower links of the three-point hitch. The frame is adjustably connected to a rod 16 which is pivotally attached to the top link of the three-point hitch. The orientation of the frame relative to the tractor may be varied. The frame is typically made from tubular steel sections.

The post hole digger 10 also comprises a boom 20 formed by a pair of boom arms 21 joined by crosspieces 22, 23. Typically, crosspiece 22 is a cross beam formed from a length of steel tube. Crosspiece 23 is an inverted U-shaped cross member joining the distal ends of the arms 21. A pivot rod 24 extends between the distal ends of the arms 21.

The proximal ends of the arms 21 are pivotally connected to the upper ends of respective legs 13. Typically, each arm 21 is pin-jointed to a respective leg 13, such that the boom 20 may pivot about a generally horizontal axis relative to the frame 11.

A hydraulic cylinder 25 is connected between the upper end of the yoke 14 and the cross beam 22. In use, the hydraulic cylinder 24 can be powered by a hydraulic pump on the tractor and controlled by a valve switch located on or near the tractor console.

A drill head 30 is pivotally suspended from the rod 24 at the distal end of the boom 20. The drill head 30 typically comprises a gear box having an input stub shaft at one side thereof, and an output stub shaft protruding from its lower end. In use, an auger 31 is connected to the output shaft of the drill head 30. A drive shaft 32 is connected between the input shaft of the drill head 30 and the power take off (PTO) of the tractor 12.

The hydraulic cylinder 25 can be operated by the tractor operator to pivot the boom 20 relative to the frame 11, and thereby raise and lower the auger 31, as shown in FIGS. 2–5. The operator can also drive the auger 31 from the tractor's PTO. In use, as the auger drills a hole into the ground, the hydraulic cylinder 25 pivots the boom 20 downwardly to put downward pressure on the auger. Such power-assisted or "hydraulic thrust" drilling enables holes to be formed faster and/or in harder ground.

Figure 6:
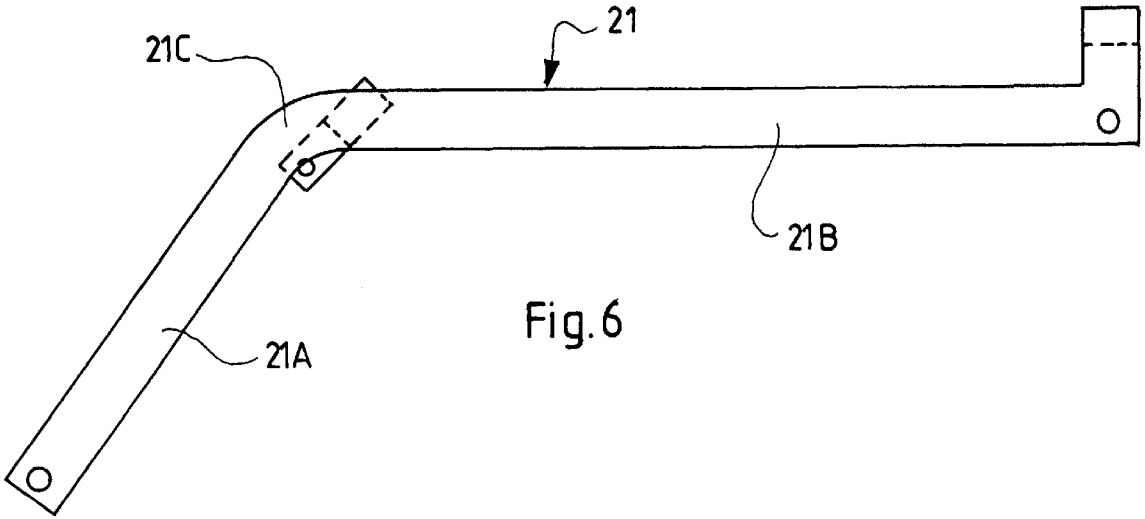
FIG. 6 is a side elevation of the boom assembly of the post hole digger of FIG. 1.
Figure 7:
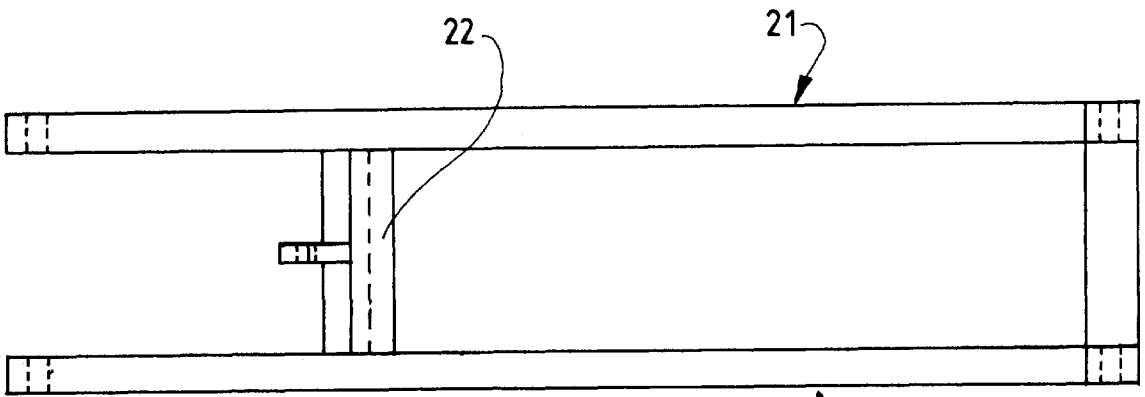
FIG. 7 is a plan view of the assembly of FIG. 6.
Figure 8:
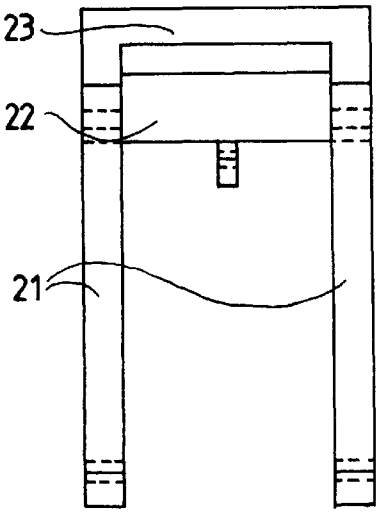
FIG. 8 is an end elevation of the boom assembly of FIG. 6.

A particularly advantageous feature of the above described post hole digger is the construction of the boom 20, shown in more detail in FIGS. 6–8. Each arm 21 is an integrally formed member of angled configuration, having a straight proximal portion 21A, a straight distal portion 21B, and an intermediate curved portion 21C. Typically, the included angle between the straight portions 21A and 21B is between 120° and 140°, and preferably around 125°. Unlike the bipartite boom arms of the post hole digger of U.S. Pat. No. 5,507,354, the boom arms 21 of this invention are each formed by a single piece.

Each arm 21 is suitably a length of rolled hollow section (RHS) high tensile steel which is bent in a cold working process, i.e. at substantially ambient temperature with no welding required. The length of RHS may be cold rolled or curved in a pipe bender or other suitable jig to the desired angular configuration. In the illustrated embodiment, each arm 21 is formed from a length of dual grade 350/450/600 high tensile steel RHS, 75 mm×50 mm in section with 5 mm wall thickness.

The cold working of a single length of steel tube to form each boom arm 21 reduces manufacturing time and costs as cutting and welding are avoided. The use of unipartite curved arms also reduces the bulk and weight of the boom. In prior art bipartite welded boom arms, concentrated stress at the rigid welded joint in the boom arm could cause the arm to fail at that joint. However, as each of the arms 21 of the post hole digger 10 of this invention is an integrally formed length of steel tubing which has been curved in a cold working process, the curvature of the angled portion of each boom arm 21 permits the arm to flex to some degree, making the arm less likely to fail under high load. Moreover, the forces acting on the angled section of each arm 21 are not concentrated on a single welded joint, but rather are distributed along the curved portion, thereby avoiding high stresses at any particular point. For a given strength rating, smaller boom arms can be used compared to known post hole diggers.

Further, as can be seen in the drawings, by positioning the cross beam 21 near the bend of the boom arms 21, the force imparted to the boom 20 by the hydraulic cylinder 22 is directed substantially in the direction of the distal portion 21B rather than transverse to it.

In addition to the advantages described above, the illustrated post hole digger has the following advantages:

The cold working of the unipartite lengths of steel to form the curved arms allows most of the strength characteristics of the lengths to be retained.

By making the distal section 21B longer than the proximal section 21A, and mounting the hydraulic cylinder 25 adjacent the curved portion 21C, only a short travel distance of the ram of the hydraulic cylinder is required in order to accommodate the full drilling depth of the auger 31. For example, in the illustrated embodiment, a 12 inch ram travel provides a 5 foot drilling depth.

When the boom 20 is raised for transport, the auger 21 can be located within the curvature of the boom.

The ram 25 does not protrude above the boom arm 20.

The dual arm construction of the boom 20 provides lateral stability to the drill head 30 and auger 31.

The drilling apparatus is designed and dimensioned such that, at mid-depth drilling point, the auger 31 is approximately tangential to the boom. In this manner, although the distal end of the boom moves in an arc, the lateral deviation of the drill head 30 and auger 31 is minimized.

The boom 20 can be detachably mounted to the frame 11, to permit the frame 11 to be used for other applications.

The foregoing describes only one embodiment of the invention, and modifications which are obvious to those skilled in the art may be made thereto without departing from the scope of the invention. For example, the arms 21 may be continuously curved along all, or a major part, of their length.

Moreover, the drilling apparatus of this invention is not limited to the illustrated post hole digger, but can be used for other purposes, such as drilling for soil samples, drilling footings and other earthworking.

What is claimed is:

1. Drilling apparatus comprising a frame suitable for attachment to a three-point hitch at the rear of a tractor, a boom pivotally connected at its proximal end to the frame, the boom being pivotable relative to the frame about a substantially horizontal pivot axis, an auger rotatably mounted to the boom at or near the distal end of the boom, a hydraulic cylinder connected between the boom and the frame, for pivoting the boom relative to the frame to thereby raise or lower the auger, wherein the boom comprises a pair of boom arms spaced laterally apart and connected by at least one crosspiece located intermediate the ends of each boom arm, each boom arm being an integrally formed unipartite angled arm which extends substantially from the proximal end to the distal end of the boom, and wherein the hydraulic cylinder is connected between the frame and the crosspiece, and is located wholly above the pivot axis.

2. Drilling apparatus as claimed in claim 1, wherein the or each angled arm comprises a proximal straight portion, a distal straight portion, and a curved portion between the proximal and distal portions.

3. Drilling apparatus as claimed in claim 2, wherein the crosspiece is positioned between the respective arms at a location adjacent the junction of the distal straight portion and the curved portion of each arm.

4. Drilling apparatus as claimed in claim 2, wherein the or each arm is formed from a length of metal tube shaped by a cold working process.

5. Drilling apparatus as claimed in claim 4, wherein the metal tube is a length of steel RHS tube shaped by bending in a pipe bender.

6. Drilling apparatus as claimed in claim 2, wherein the distal straight portion is longer than the proximal straight portion.

7. A boom for a tractor-mounted post hole digger, the boom comprising a pair of boom arms spaced laterally apart and connected by at least one crosspiece located intermediate the ends of each boom arm, each boom arm being an integrally formed unipartite angled arm extending substantially the whole length of the boom, and wherein each angled arm comprises a proximal straight portion, a distal straight portion, and a curved portion between the proximal and distal portions.

8. A boom as claimed in claim 7, wherein the or each arm is formed from a length of metal tube shaped by a cold working process.

9. A boom as claimed in claim 8, wherein the metal tube is a length of steel RHS tube shaped by bending in a pipe bender.

10. A boom as claimed in claim 7, wherein the distal straight portion is longer than the proximal straight portion.

11. A method of forming a boom for a post hole digger, the boom comprising a pair of boom arms spaced laterally apart and connected by at least one crosspiece located intermediate the ends of each boom arm, each boom arm being an integrally formed unipartite angled arm extending substantially the whole length of the boom, and having a proximal straight portion, a distal straight portion, and a curved portion between the proximal and distal portions, the method comprising the steps of bending two lengths of metal tube in a cold working process to form the respective angled arms, juxtaposing the angled arms such that they are spaced laterally apart, positioning the crosspiece between the curved portions of the arms, and joining the crosspiece to the angled arms.

12. A method as claimed in claim 11, wherein the metal tubes are lengths of steel RHS tube.

* * * * *